United States Patent [19]

Browning et al.

[11] 3,963,914

[45] June 15, 1976

[54] COMBINATION WRITING IMPLEMENT AND FLASHLIGHT

[76] Inventors: Scott M. Browning, 3269 Polk Ave., Ogden, Utah 84403; Gregory F. Klomp, 2500 Fillmore, Ogden, Utah 84401

[22] Filed: Apr. 9, 1975

[21] Appl. No.: 566,371

[52] U.S. Cl. ..... 240/6.46; 240/2 E; 401/195; 401/213

[51] Int. Cl.[2] ..... F21L 1/00; B43K 29/10

[58] Field of Search ..... 240/6.46, 10.66, 2 E, 240/6.42, 6.4 R, 1 LP; 401/195, 213

[56] References Cited

UNITED STATES PATENTS

| | | | |
|---|---|---|---|
| 2,642,519 | 6/1953 | Caustin et al. | 240/6.42 |
| 2,696,382 | 12/1954 | Gelardin | 240/10.66 X |
| 3,604,917 | 9/1971 | Schmidt | 240/10.66 X |
| 3,737,650 | 6/1973 | Kaye et al. | 240/10.66 |
| 3,806,724 | 4/1974 | Tanner et al. | 240/10.66 |

FOREIGN PATENTS OR APPLICATIONS

| | | | |
|---|---|---|---|
| 1,561,780 | 11/1969 | Germany | 240/2 E |

*Primary Examiner*—Hix. L. T.
*Assistant Examiner*—E. M. O'Connor

[57] ABSTRACT

A flashlight and writing implement combination wherein the device is interiorly illuminated, and ultimately conducts such illumination in either of two directions, depending upon on which end the cap of the implement is placed. The cap includes reflective means for reversing light-flow back through the light-conductive or translucent barrel, toward the end piece and to the writing tip itself, concentrically thereabout. Optionally, the cap is disposed on the reverse end, in which event the light is actuated to send illumination in the opposite direction, the device thereby serving as a flashlight. Aperture means may be provided the cap so that the usually provided clip can be depressed to actuate the pressure switch of the implement. The cap can be made of a resilient deformable plastic material so that by squeezing the same the pressure switch means of the implement may be actuated.

7 Claims, 8 Drawing Figures

COMBINATION WRITING IMPLEMENT AND FLASHLIGHT

The present invention relates to writing implements and, more particularly, to an improved writing implement that can serve both as a flashlight and also a writing tool.

The subject invention comprises the combination of a writing implement device and cap. The cap can be screwthreaded onto the barrel of the device and be stored in a user's pocket. When the device is retrieved, the cap can be squeezed or the clasp depressed so that the pressure switch of the implement is actuated to illuminate an interior light, thereby serving to render the device a pen-like type of flashlight. The cap of the implement includes a reflector means within the cap which serves to reverse the direction of illumination of the interior light of the implement such that such illumination proceeds down the light-conductive barrel and end piece to a location proximate the writing tip of the implement. To concentrate the light, the bulb can be coated or covered with some opaque substances or material, and the forward end of that portion surrounding the writing cartridge can be annularly beveled interiorly, thereby tending to focus the light proximate the tip.

Accordingly, a principal object is to provide a new and improved illuminated writing implement.

A further object is to provide a combination writing implement and pen-like type of flashlight.

A further object is to provide a writing implement such that the cap thereof will include a reflector, to reflect interiorly-generated light back to the tip of the implement.

A further object is to provide a pen which optionally functions as a flashlight.

A further object is to provide a pen and flashlight combination wherein the cap thereof serves not only storage purposes but also can be manipulated to close a pressure switch for the implement such that the self-contained light can be energized.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the writing implement - flashlight combination of the present invention.

FI. 2 is a longitudinal cross-section of the device of FIG. 1, showing battery and bulb location, pressure switch construction, and so forth.

Figure 1:
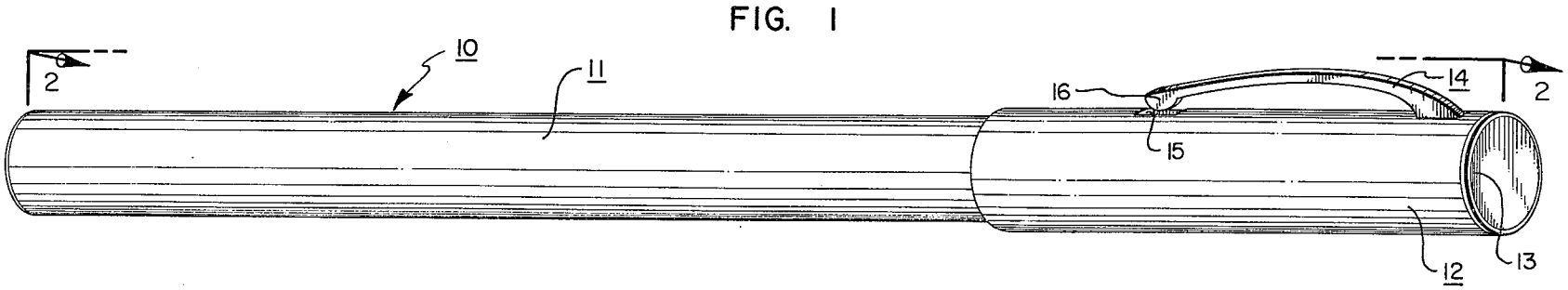

In the drawings the device 10 is shown to include a writing implement 11 and also a cap 12. Cap 12 comprises the cap member 13 and also 13 clip 14 integral therewith. The cap member 3 comprises a barrel and includes an access aperture 15 for receiving the nub end 16 of pocket clip 14 when the latter, being resilient, is depressed, this for purposes hereinafter explained.

The writing implement includes a transparent or translucent barrel 47 which preferably has an outer opaque coating, wrapping, or circumscribing cylinder 17. Barrel 47 has an open end at 18 that is preferably beveled and includes threads 19 for receiving the threads 20 of guide nut 21. Nut 21 may be of translucent plastic and in any event includes a central aperture 22 which serves as a guide for receiving the bulb 23 of light 24. Light 24 is backed by series-touching batteries 25 and 26, with battery 25 abutting electrically conductive spring 27.

An outer conductive strip 28 includes a doubledback leg 29 that is spring-tensioned internally to abut against and make secure contact against the threaded metal base 30 of bulb 24. The forward end of conductive strip 28 is doglegged at 31 to provide a depressible portion at 32 which will be hereinafter explained. Inner conductive strip 33 is formed to have a foot 34 that rests against or is secure to the under surface 35 of portion 36 and is in contact with compression spring 27. A rubber or other insulative strip 38 is disposed between the inner and outer conductive strips 33 and 28 respectfully.

The inner conductive strip 33 may terminate in a ring portion 37 that goes completely about the recessed area 48 of portion 36. Correspondingly, the outer conductive strip terminates in a ring-shaped annular portion 39 that goes completely about the inner ring.

Figure 5:
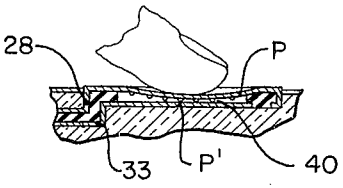
FIGS. 4 and 5 are enlarged fragmentary details showing the pressure switch construction and its actuation; as to the latter, see FIG. 5.
Figure 4:
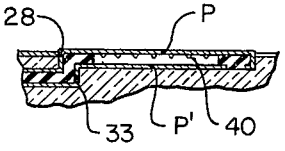
Figure 3:
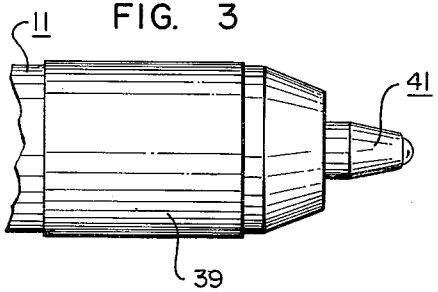
FIG. 3 is an enlarged detail of the writing end of the implement of FIG. 2.
Figure 6:
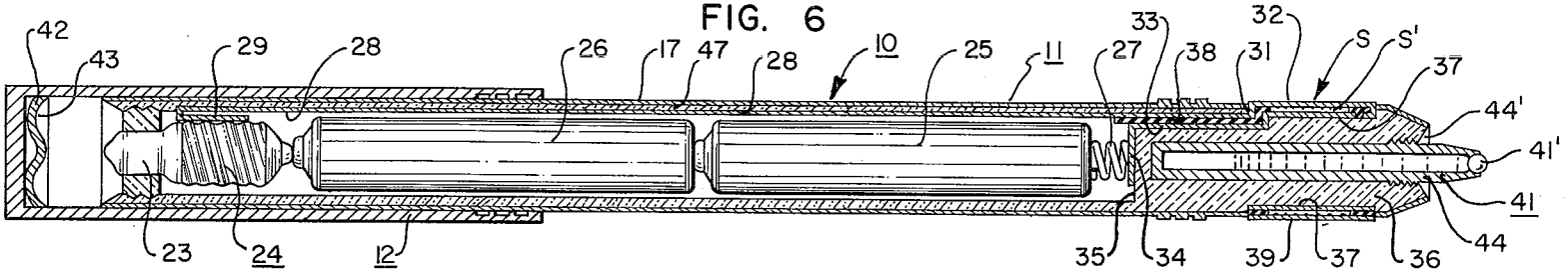
FIG. 6 illustrates the device when the cap is disposed on the light-end of the implement, thereby permitting the reflector contained within the cap to reflect the light downwardly through the translucent barrel so that light will appear proximate the writing tip of the implement.

Thus, in the case of FIGS. 3, 5 and 6, for example, the writer can simply squeeze slightly his thumb and fingers together so as to light the light 24. This is performed by simply urging the two conductive strips at their forward portions P and P′ or rings 32 and 37 together. Protuberances at 40 may be supplied to either one or both of the pressure switch and ring portions.

Portion 36 may interiorly receive an exchangeable translucent implement tip 41 that can simply comprise an inkfilled wall translucent cartridge having an end ball 41′, or a felt tip or other writing transfer agent.

For purposes hereinafter explained, a reflector 42 is provided at the end of cap 12 and will be suitably silvered or provided with a reflective surface 43, such that light may be reflected therefrom.

Thus, when the cap is on the reverse end of the writing implement, as shown in FIG. 6, then the user may simply squeeze together the switch means S, comprised of portions 32 and 37 and having gap S′, so that the light will be reflected from reflector 42.

It is important to note that the replaceable unit 41 includes a light transmissive cartridge barrel 44 for receiving ink or other writing medium. Additionally, the annular beveled end 44′ serves to orient the light proceeding through portion 36 to the writing surface immediately proximate the point or ball at 41′.

It will be noted that portion 36 may be integral with 47 as shown, or the same may comprise a separate part press-fitted into or otherwise secured to the barrel portion that encloses batteries 25 and 26.

An essential point to note is that light is transmitted from the bulb 23, when energized by closure of the pressure switch means S, through the guide nut 21, preferably transparent, and also via the reflector 42 toward end portion 36, to light the writing surface area proximate tip 41'. This is the operating condition shown in FIG. 6. On the other hand, when the cap member 13 is replaced in the manner shown in FIG. 2, then the light 24 can simply be actuated by a flashlight, with the user pressing down on the clasp of cap 12 so that the nub 16 urges the two contacting strips together to form a closed circuit for the light. An insulative layer 38 is used, of course, to space the inner and outer conductive strips.

Figure 2:
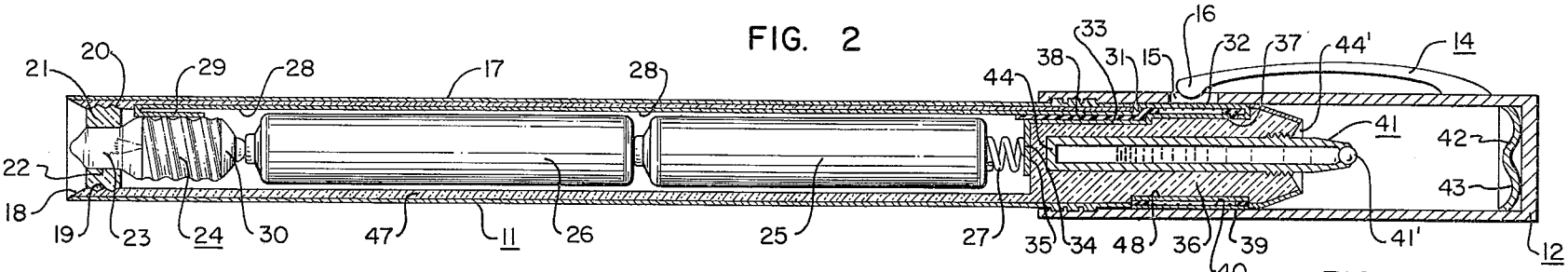

Optionally, the cap member 13 can be resilient as by being made by a medium density polyethylene or acrylic stock, approximately 3/32nds of an inch in wall thickness, so that the same can be pinched or depressed to actuate the pressure switch in the condition of the structure shown in FIG. 2, in which event the light will light and light illumination will proceed outwardly to the left.

What is provided therefore is a writing implement which has rearwardly disposed illuminating means, useful to serve the implement as a flashlight or light indicator when the cap is removed from the light end, or to serve to reflect the light from the interior of the pen cap back through the writing structure to illuminate that portion of the structure proximate the writing tip, be it ball point, writing felt or pencil lead. All transparrent or translucent parts, such as barrel 47, guide nut 21, end piece 36, and the cartridge barrel 44, may be fabricated from plastic going under the trade name Lucite, or from medium density polyurethane, by way of example.

Figure 7:
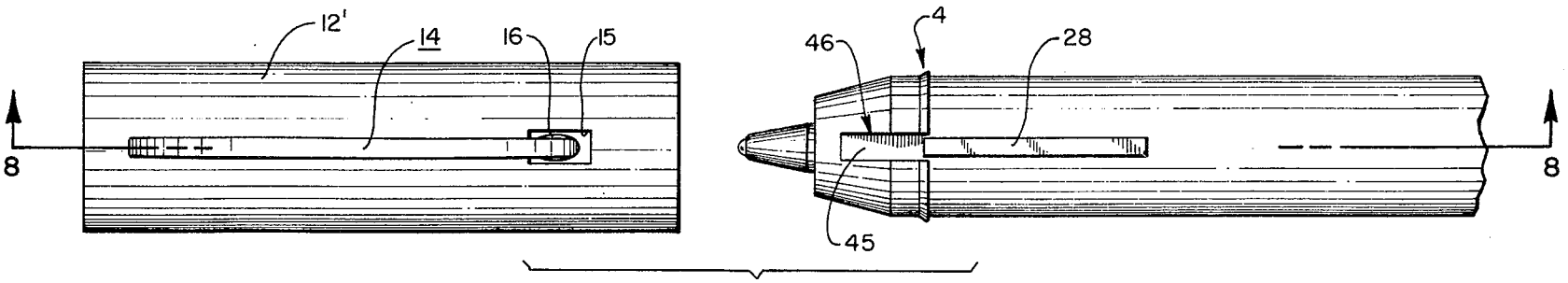
FIG. 7 is a plan of an alternate writing device, with the cap and writing implements being shown mutually separated.
Figure 8:
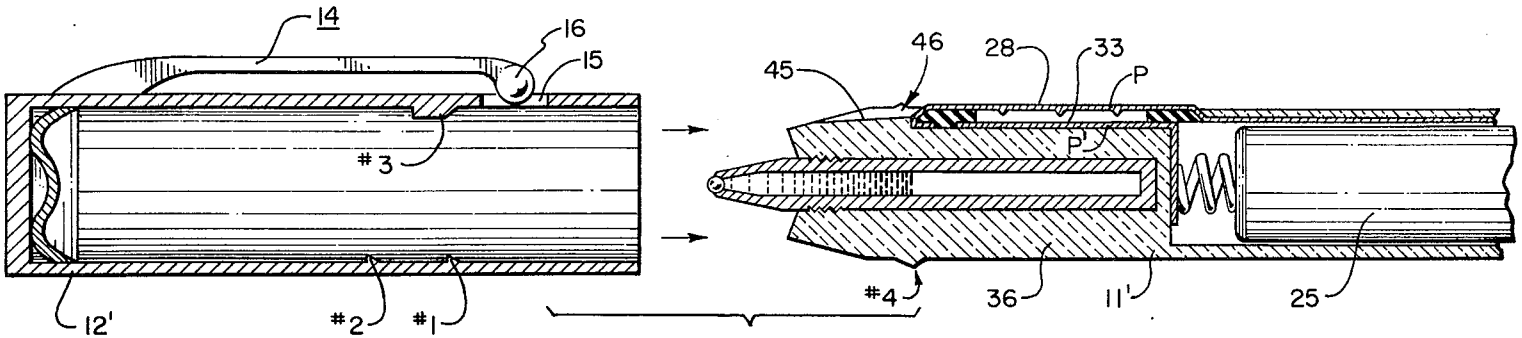
FIG. 8 is a longitudinal section taken along the line 8—8 in FIG. 7.

FIGS. 7 and 8 illustrate an alternate writing device wherein modified cap 12' and writing implement 11', corresponding to cap 12 and writing implement 12 of FIG. 2, are shown. Cap 12' is provided with locking juts No. 1 and No. 2 and also with interior cap knob No. 3. Implement 11' is provided with slot 46 provided with inclined base surface 45 dimensioned to receive knob No. 3.

The above-described structure provides the following alternate, cap-switching functions:

The two methods to depress finger switch contact portion P and P' of conductive strips 28 and 33 when cap 12' is on this end are as follows:

1. For intermittent operation — cap 12' is pushed onto pen until locking jut No. 1 overrides and mates with locking jut mate No. 4. Now clip nub 16 is positioned over the switch, comprising conductive strip portions P and P', and will close the circuit when pressed through the hole 15 in the cap 12'.
2. For continuous operation — cap 12' is advanced until locking jut No. 2 engages with locking jut mate No. 4. Now cap knob No. 3, having ridden up base 45 of slot 46, will be pressing the outer conductive strip 28, at portion P, against the inner conductive strip 33, at portion P', to complete the circuit and light the switch.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. A self-illuminating writing device including, in combination, a writing implement having a reverse end and a forwardly oriented writing tip, said reverse end being provided with light means, and a cap selectively positioned over said writing tip and also removable therefrom for selective positionment over said reverse end having said light means, said light means facing away from said tip for emitting observable light energy in a direction reverse to the forward orientation of said tip when said cap is removed from said reverse end, said implement including translucent structure transmitting said light energy proximate said tip, said cap including an internal reflector means, facing said light means when said cap is disposed on said reverse end of said writing implement, for reflecting light energy through said implement to said tip when said cap is so disposed on said reverse end of said implement, said implement including an internal battery and switching means for selectively coupling said battery to said light means.

2. The combination of claim 1 wherein said writing implement includes a translucent barrel having a translucent end piece receiving said writing tip.

3. The combination of claim 1 wherein said writing tip comprises a hollow, ink filled, translucent, replaceable writing cartridge having a writing element communicating with the interior thereof.

4. The structure of claim 1 wherein said switching means comprises a pressure-actuated switching means carried on a side of said writing implement proximate said point, said cap being formed of yieldable material, whereby thumb-and-finger pressure against said cap to distort the transverse cross-section thereof so to engage said switch means to produce actuation thereof.

5. The structure of claim 1 wherein said switching means comprises a pressure-actuated switching means carried on a side of said writing implement proximate said point, said cap having a barrel provided with a wall aperture and also a resilient clasp depressable through said aperture to thrust against and thereby actuate said switching means.

6. The structure of claim 1 wherein said cap and writing implement have mutually intercooperable means for effecting both continuous and also intermittent actuation of said switching means.

7. The structure of claim 2 wherein said end piece is integrally formed with said barrel and carries said switching means.

* * * * *